United States Patent [19]

Kleim

[11] 4,318,345

[45] Mar. 9, 1982

[54] RAILWAY VESTIBULE CONNECTION

[75] Inventor: Karl-Heinz Kleim, Nuremberg, Fed. Rep. of Germany

[73] Assignee: Maschinenfabrik Augsburg-Nuernberg A.G., Nuremberg, Fed. Rep. of Germany

[21] Appl. No.: 124,784

[22] Filed: Feb. 26, 1980

[30] Foreign Application Priority Data

Mar. 3, 1979 [DE] Fed. Rep. of Germany ..... 2908354

[51] Int. Cl.[3] ..... B60D 5/00; B61D 1/00; B61D 17/22; B61G 11/04

[52] U.S. Cl. ..... 105/15; 105/3; 105/17; 105/18; 213/222

[58] Field of Search ..... 105/3, 4 R, 15, 16, 105/17, 18, 19, 20, 21; 213/222

[56] References Cited

U.S. PATENT DOCUMENTS

| | | | |
|---|---|---|---|
| 568,166 | 9/1896 | Miller | 105/21 X |
| 867,007 | 9/1907 | Boyes et al. | 105/3 X |
| 1,114,552 | 10/1914 | Taurman | 105/3 |
| 1,794,516 | 3/1931 | Gunn et al. | 105/18 X |
| 1,943,370 | 1/1934 | Cornet | 105/18 X |
| 2,109,275 | 2/1938 | Pflager | 105/21 X |
| 2,568,684 | 9/1951 | Mihaly | 105/18 |

FOREIGN PATENT DOCUMENTS

| | | | |
|---|---|---|---|
| 324598 | 1/1960 | Switzerland | 105/15 |

*Primary Examiner*—Joseph F. Peters, Jr.
*Assistant Examiner*—Howard Beltran
*Attorney, Agent, or Firm*—Karl H. Gross

[57] ABSTRACT

A vestibule connection for the adjoining ends of two cars of a rapid-transit vehicle includes an apron which is maintained centered in the space between turntables at the adjoining ends, by being mounted on two transverse parallel shafts via telescopable units that are pivoted to these shafts and alternate ones of which, as considered in direction lengthwise of the shafts, exert a biasing action on the apron in mutually opposite directions along the centerline of the two cars.

3 Claims, 5 Drawing Figures

RAILWAY VESTIBULE CONNECTION

BACKGROUND OF THE INVENTION

This invention relates to a vestibule connection for a rapid transit vehicle, specifically a rail vehicle, where two adjoining car ends are enclosed by bellows extending around the full car contour and where the gangway is formed by a split turntable each provided with a joint and an apron bridging the middle between the turntables, as well as lateral screens which are also of divided construction with divided parts pressed against each other and maintained flexible by spring hinges.

In order to provide a continuous connection of car bodies it has generally been known to equip cars moving on bogies with a vestibule connection comprising bellows or rubber volutes extending around the full car contour to provide the seal and turntables. The known types of vestibule connections suffer from a drawback in that the gangway device is not capable of accommodating changes in the relative distance between the car ends.

SUMMARY OF THE INVENTION

In contrast to this, the present invention has for its object to provide two car bodies which are not supported on a common bogie, but are connected by a spring-action central buffer coupler, with a wide vestibule connection level with the car floors which affords convenient and, at the same time, safe access from one car to the other for the passengers.

This object is achieved by the features of the present invention.

The arrangement according to the invention permits vestibule connections to be constructed which extend over almost the full width of the cars. Even when negotiating "S" curves with a radius of as small as 100 m and an intermediate straight length of 2 m, the vestibule connection undergoes only a minor reduction in width and passengers can safely pass through because there are no gaps or openings (where passengers could be trapped). In conjunction with the bellows extending all around the joint and the divided screens, a hermetic enclosure and a visually pleasing connection are achieved. The joint between the turntable and the car floors or apron, respectively, on the one hand and telescopic devices supported via horizontally disposed shafts in pivot bearings on the other hand, afford a high degree of flexibility between the cars connected by a spring-action central buffer coupling and moving on their own bogies separately from each other.

A further advantageous embodiment of the invention consists in having the facing segments of the turntables separated from the latter by joints and supported on the shafts of the telescopic devices for vertical flexibility and mounted on the apron in a manner permitting them to slide longitudinally, and in having the turntables which are flush with the car floors carried on sliding elements in the underframes of the allied car bodies.

The flexible mounting of the facing segments of the turntables in conjunction with the vertically swinging telescopic devices permit relative vertically movement of the car ends and, cooperating with the turntables which are flush with the car floors, also permit convenient and safe passenger movement between the cars.

BRIEF DESCRIPTION OF THE DRAWING

A typical embodiment of the vestibule connection and its position when negotiating track curves is shown in the accompanying drawings in which.

DESCRIPTION OF PREFERRED EMBODIMENTS

Figure 1:
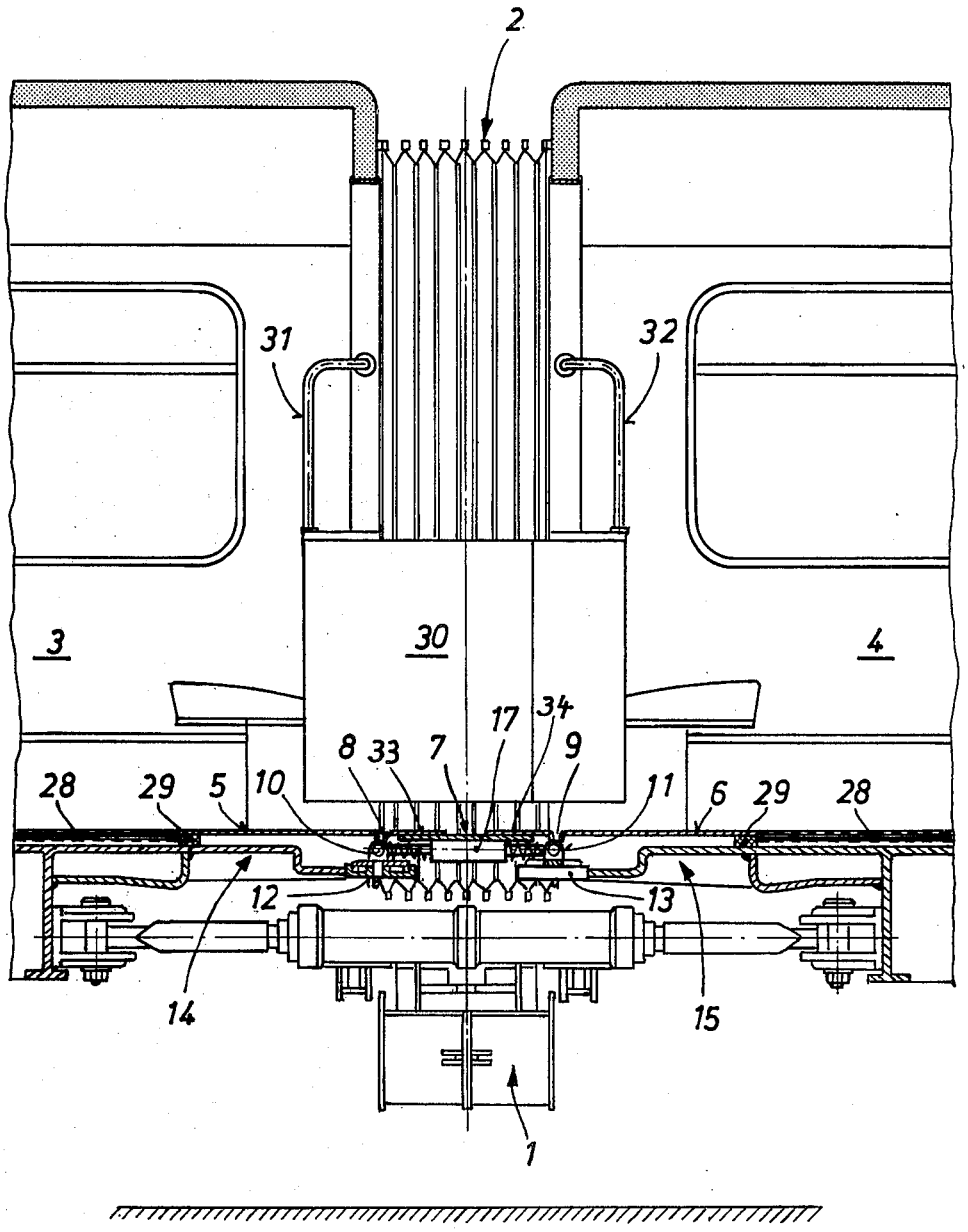
FIG. 1 is a section along the line I—I of FIG. 2 in the area of the bestibule connection showing the central buffer coupler.

A vestibule connection with a central buffer coupler 1 and bellows 2 extending around the full car contour is shown in longitudinal section in FIG. 1. The transition between the two car ends 3, 4 is covered by turntables 5, 6 in the shape of segments of circles and an apron 7 which compensates longitudinal movements. These parts are all constructed flush with the floors. The turntables 5, 6 are provided with joints 8, 9 in order to permit movement of the car bodies 3, 4 in the vertical direction without any constraint. The facing segments 33, 34 of the turntables 5, 6 facing the coupling plane are supported on the apron 7 starting from the joint in a manner permitting longitudinal movement. The turntables 5, 6 and their allied facing segments 33, 34 each bear with their dead weight at the joints 8, 9 on a shaft 10 and respectively 11 which are supported in turn about their vertical axes in pivot bearings 12, 13 in an underframe 14, 15 of the two car bodies 3, 4. Hinged to the shafts 10, 11 are three telescopic devices 16, 17, 18 permitting them to swing vertically while being located longitudinally by the shafts 10, 11. The telescopic devices are arranged one at the centre and two at the sides. The axially movable tubes 22, 23, 24 guides on the stationary rods 19, 20, 21 of the telescopic devices 16, 17, 18 are firmly attached to the apron 7. Springs 25, 26, 27 which coaxially surround the rods 19, 20, 21 of the telescopic devices 16, 17, 18 are provided to maintain the tubes with the apron 7 fitted on them at the centre between the car ends. The turntables 5, 6 which are level with the adjoining floors 28 are supported with sliding elements 29 in the underframes 14, 15 and capable of rotating about the pivot bearings 12, 13. At the sides of the vestibule connection, the bellows 2 is shielded by screens 30 which are of divided construction in order to permit relative movement. The screens 30 are pressed against each other by spring-loaded hinges which produce a torque on the two parts of the screen acting about the guide posts 31, 32 while permitting their free movement as already explained.

Figure 2:
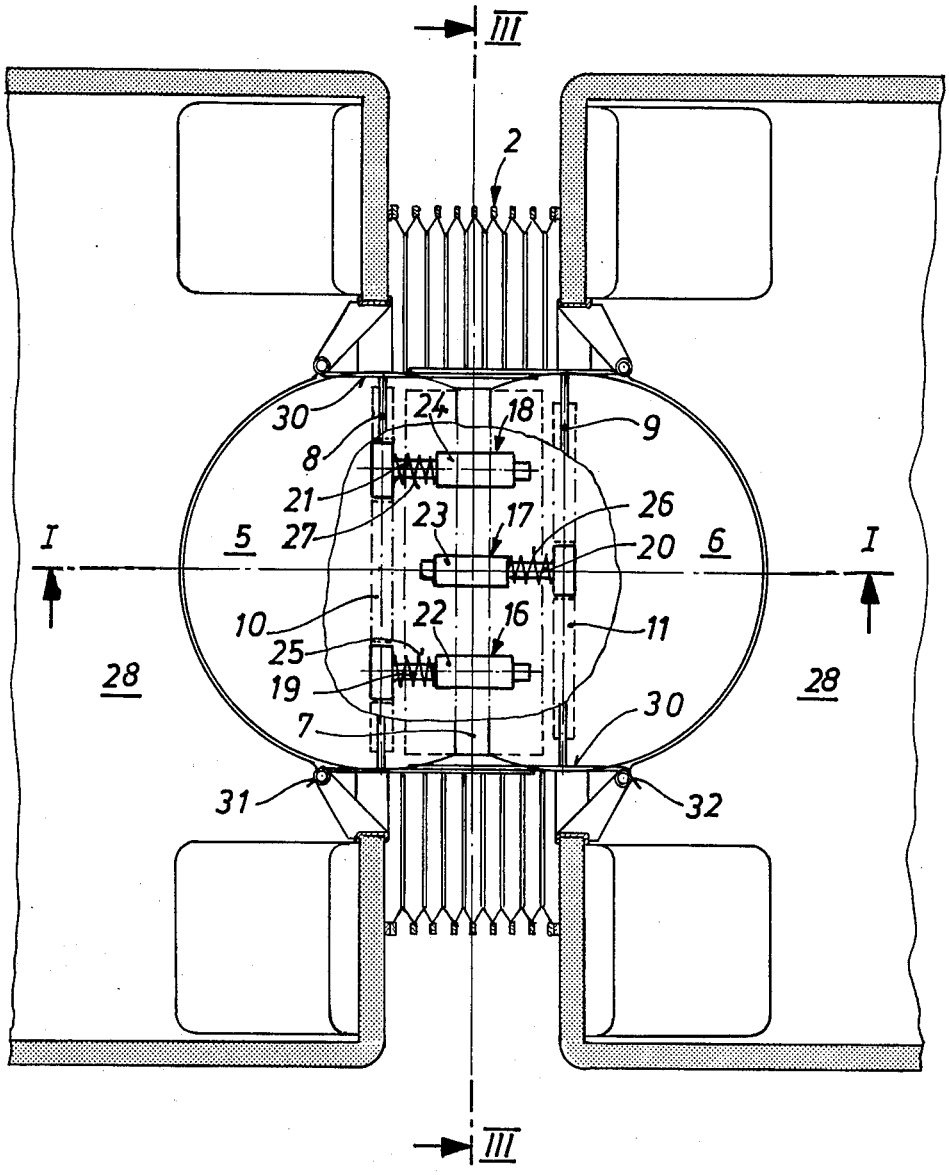
FIG. 2 is a plan view of the vestibule connection showing the turntables and apron, the latter being shown partly broken away to show the telescopic devices during straight-ahead travelling.

FIG. 2 shows the vestibule connection in plan in the straight-ahead travelling position. The turntables 5, 6 and the apron 7 are shown partly broken up so that the mounting of the telescopic devices 16, 17, 18 on the shafts 10, 11 and the pivot bearings 12, 13 (FIG. 1) can be seen. It should be mentioned that while the drawings illustrate only one possible embodiment of the invention, it is naturally possible to provide more than three telescopic devices.

Figure 3:
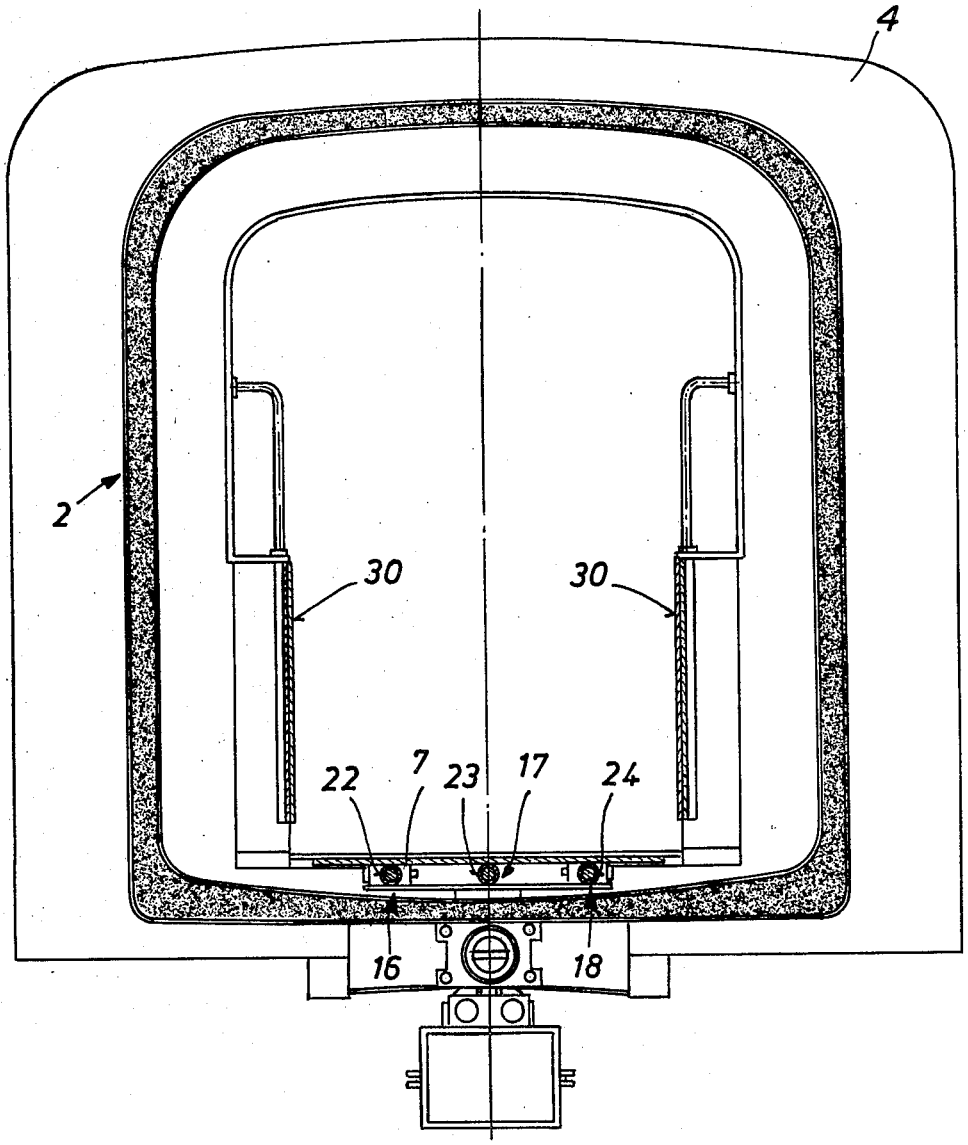
FIG. 3 is a section along the line III—III of FIG. 2 with the apron supported on the telescopic devices and the central buffer coupler beneath.

A cross-section through the vestibule connection is shown in FIG. 3. One can see the apron 7 supported by the tubes 22, 23, 24 of the telescopic devices 16, 17, 18, the apron 7 being firmly attached to the telescopic devices. Screens 30 are provided for the protection of the passengers and to conceal the bellows.

Figure 4:
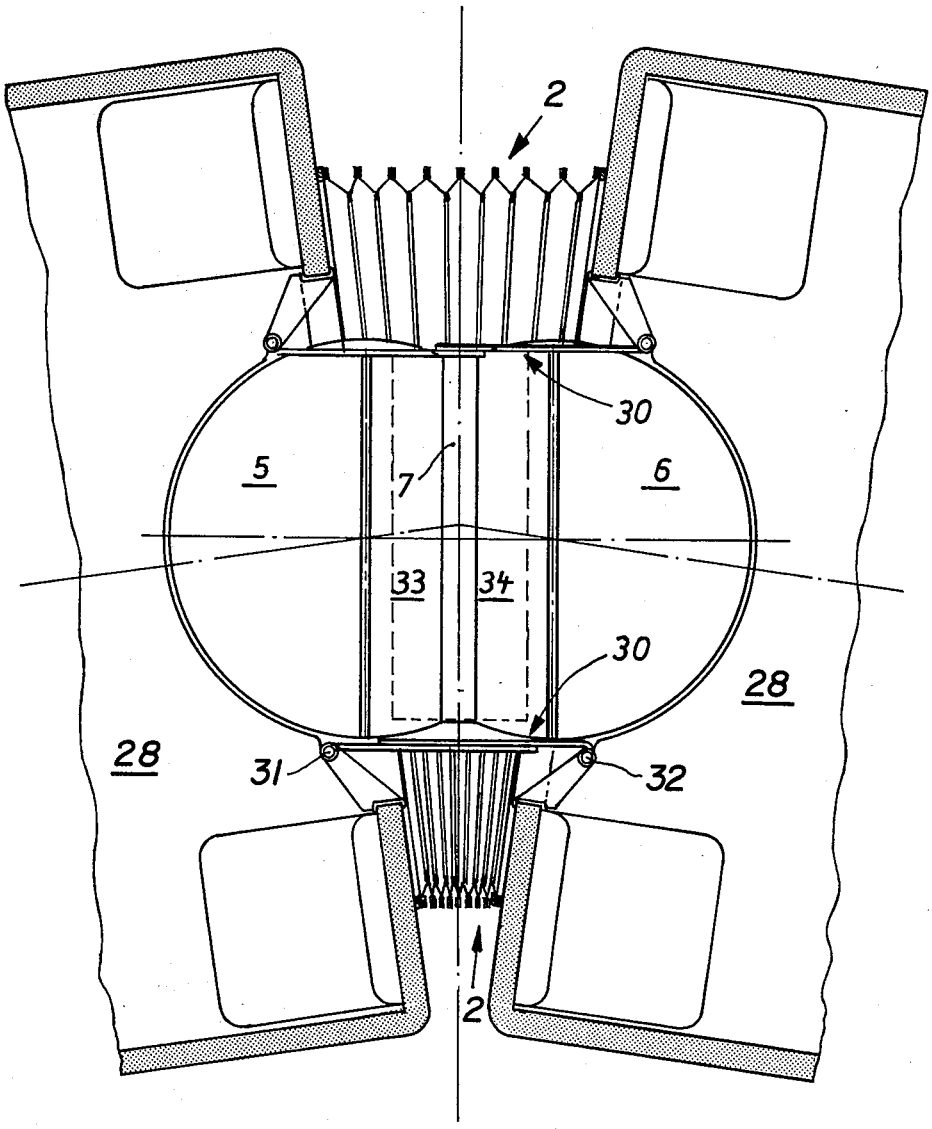
FIG. 4 is a plan view of the vestibule connection when negotiating a curve.

FIG. 4 shows the vestibule connection while negotiating a curve. Compared to the straight-ahead position illustrated in FIG. 2, the position of the turntables 5, 6 is unchanged because the turntables and the apron 7 are maintained aligned perpendicular to the connecting line between the pivot bearings 12, 13. The screens 30, however, are displaced relative to each other.

Figure 5:
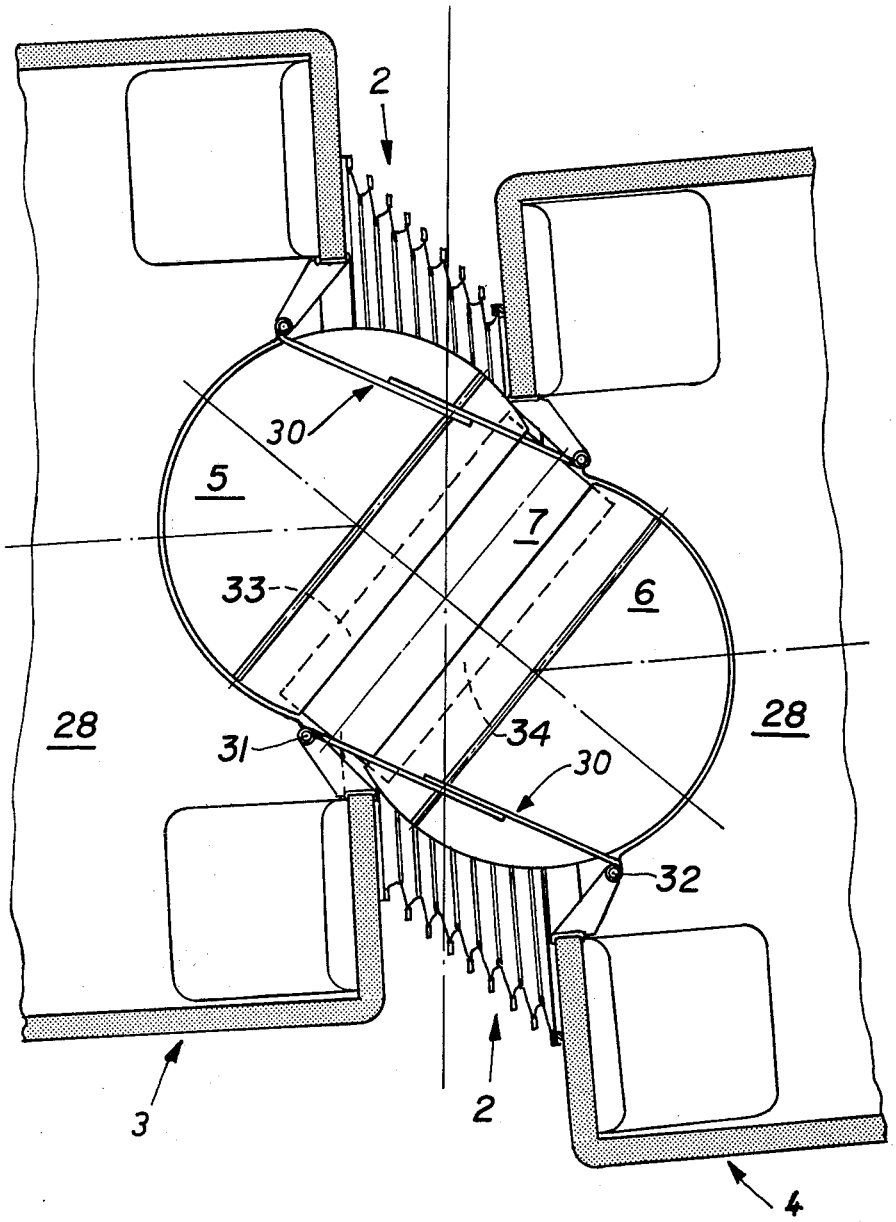
FIG. 5 is a plan view of the vestibule connection when negotiating an "S" curve with a short intermediate straight section.

The position of the vestibule connection while negotiating an "S" curve with a short intermediate straight section is represented in FIG. 5. There is considerable displacement in the transverse direction of the car ends 3, 4, but a wide passage is still obtained for access from one car to the adjoining car. The passage is guarded at the sides by the screens 30.

I claim:

1. For use in a vestibule connection for the adjoining ends of two cars of a rapid transit vehicle, wherein each car end carries a turntable turnable about a vertical axis and the turntables define an elongated transverse gap between them, a combination comprising an elongated apron extending along and bridging said gap between said turntables;

biasing means connected to and biasing said apron to a centered position in said gap relative to said turntables;

first mounting means including two parallel horizontal shafts extending lengthwise of said gap and mounting said biasing means for vertical pivoting about axes of said shafts; and second mounting means for mounting said first mounting means on the ends of said cars for horizontal pivoting about respective vertical pivots intersecting said axes of said shafts.

2. A combination as defined in claim 1, said biasing means comprising at least three biasing elements located in said gap and including a center element and two outer elements flanking said center element, said center element being connected to one of said shafts and to said apron and exerting a biasing action towards the other shaft, and said outer elements being connected to said other shaft and said apron and exerting a biasing action in direction towards said one shaft.

3. A combination as defined in claim 2, said elements being telescopic elements and each having a center rod pivoted at one end thereof to the respective shaft, a tube slidable on said rod and connected to said apron, and a biasing spring urging said tube away from said one end.

* * * * *